United States Patent [19]

Albert et al.

[11] Patent Number: 4,970,920

[45] Date of Patent: Nov. 20, 1990

[54] LEVER-ACTUATED, HAND-HELD, POWER TOOL

[75] Inventors: Gregory P. Albert, Waverly, N.Y.; Kenneth J. Dubuque, Sheshequin, Pa.

[73] Assignee: Ingersoll-Rand Company, Woodcliff Lake, N.J.

[21] Appl. No.: 331,427

[22] Filed: Mar. 30, 1989

[51] Int. Cl.[5] ..... B25B 13/00

[52] U.S. Cl. ..... 81/57.44; 173/90; 74/523

[58] Field of Search ..... 81/57.44, 469, 470; 173/90, 104, 105; 74/519, 523

[56] References Cited

U.S. PATENT DOCUMENTS 3,361,218 1/1968 States ..... 81/470
3,505,928 4/1970 Whitehouse ..... 81/470 X
3,538,787 11/1970 Briar et al. ..... 74/523 X
4,762,018 8/1988 Yoshigai ..... 74/523

*Primary Examiner*—James G. Smith
*Attorney, Agent, or Firm*—Robert F. Palermo; Bernard J. Murphy; Walter C. Vliet

[57] ABSTRACT

The tool has a circular body, and an actuating lever pivotably coupled thereto. The lever, however, has two limbs, joined through a bight, and one of the limbs is fully nested in a recess formed therefor in the body. Consequently, one may grasp the tool about the body, whereat the one limb is nested, without turning the tool on, inadvertently. The other limb extends outwardly from the body, however, and by grasping the tool thereat, and depressing this other limb, the tool is turned on.

3 Claims, 2 Drawing Sheets

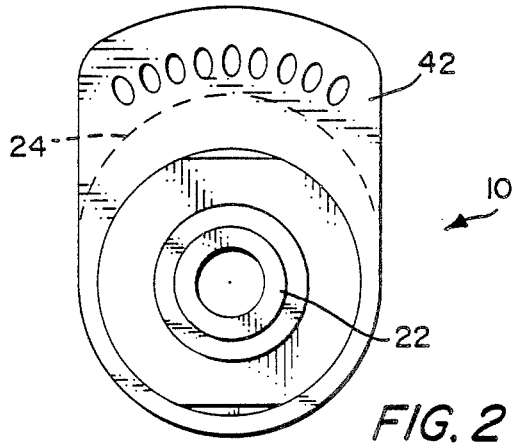
FIG. 2
FIG. 3
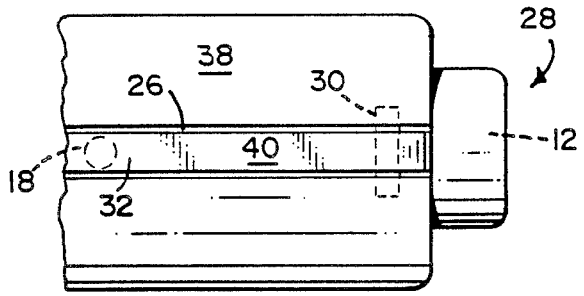

LEVER-ACTUATED, HAND-HELD, POWER TOOL

This invention pertains to hand-held, power tools, and in particular to such tools as are actuated by a lever.

Lever-actuated, hand-held, power tools, known in the prior art, have linear levers. The levers are pivoted, commonly, at one, input end of the tool, and incline therefrom toward the other, output end of the tool. To operate the tool, one has only to grasp the body thereof while closing the inclined end of the lever against the tool body. There is a problem with this, however. Frequently, one wishes to grasp the tool and not operate it; one may wish to position the tool relative to a workpiece, while it is at halt, or simply pick it up, while it is at rest, and put it aside. The inclined, linear lever, however, invariably gets grasped with the tool body and, unintentionally, the tool is turned on.

What has been needed is a hand-held, lever-actuated, power tool which can be grasped fully thereabout (a) without, inadvertently, turning the tool on, and (b) to turn the tool on, either, as one chooses.

It is an object of this invention to meet the aforesaid need. Particularly, it is an object of this invention to set forth a lever-actuated, hand-held, power tool comprising an external, tool body; said body having a first, output end, and a second, opposite end; and an actuating lever; which said body has a recessed portion; said lever is pivotably coupled, at an end thereof, to said second end of said body; said lever has a first limb which occupies a given plane, a second limb which occupies another plane, and a bight joining said first and second limbs; and one of said limbs is fully nested in said recessed portion of said body.

Further objects of this invention, as well as the novel features thereof will become more apparent by reference to the following description, taken in conjunction with the accompanying figures, in which:

FIG. 2 is a simple outline of the output end of the tool of FIG. 1 taken along 2—2 of FIG. 1; and FIG. 3 is a fragmentary view, in plan, of the input end of the aforesaid tool taken along 3—3 of FIG. 1.

Figure 1:
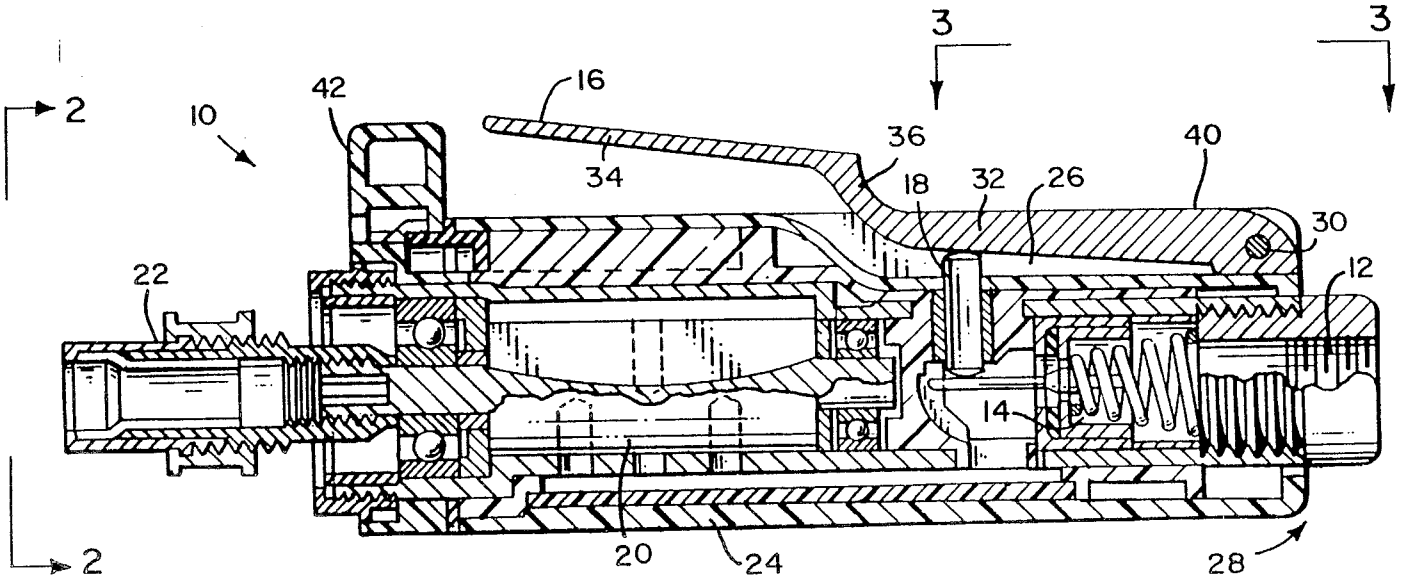
FIG. 1 is a cross-sectional view taken along the longitudinal axis of an embodiment of the invention.

As shown in the figures, a tool 10 embodying the invention comprises, by way of example, a pneumatically-powered device. Tool 10 has a compressed-air inlet 12, and a valved chamber 14 through which the compressed air is passed by the action of a lever 16 and a co-acting dowel 18. By means well known to those of ordinary skill is this art, the air powers an air motor 20 which, in turn, rotates a chuck 22. The chuck is configured to receive the shank of a grinding disc, or the like, with which to dress a workpiece.

The tool 10 has an external generally cylindrical body 24 which has a channel 26 formed along the air inlet end 28. Adjacent to the inlet 12, and transverse to the channel 26 is a pivot pin 30. Pin 30 pivotably journals thereat a first elongated limb 32 of the lever 16. First limb 32 is joined to a second elongated limb 34, through a bight 36, which angularly inclines up and slightly away from the body 24 so that both limbs lie in separate and substantially parallel planes.

As can be seen, in its released position, limb 32 is wholly nested in the channel 26. The body 24, of circular cross-section, has an outermost, cylindrical surface 38, and limb 32 has an outermost land 40 which substantially defines a continuum for the surface 38 across the channel 26.

In accordance with the invention, then, the rear, air inlet end 28 of the tool 10 can be grasped and handled without powering the air motor 20. Too, the tool 10 can be grasped about the forward, output end to depress the lever 16 and power the air motor 20. When the tool 10 is grasped about the forward end, and the lever 16 is depressed, limb 34 assumes an overlying disposition upon the body 24.

The body 24 has a somewhat sectored flange 42 at the forward end. This serves as a guard for the operator's hand, and as a bearing surface against which the tool operator may push to apply a selective pressure to the workpiece.

While we have described our invention in connection with a specific embodiment thereof it is to be clearly understood that this is done only by way of example and not as a limitation to the scope of our invention as set forth in the objects thereof and in the appended claims.

We claim:

1. A lever-actuated, hand-held, power tool, comprising:

an external tool body having a generally cylindrical shape with a first, output end, a second, opposite end, and a recessed portion;

an actuating lever pivotably coupled at one end to said second end of said body and having a first elongated limb, shaped so as to close onto said cylindrical surface of said body when pivotably depressed, which occupies a given plane, a second elongated limb which occupies another substantially parallel plane, and a bight joining said first and second limbs; and said second limb, being pivotably coupled to said body at said second, opposite end, is fully nested in said recessed portion of said body in its released position and substantially defines a continuum of the cylindrical surface of said body across said recessed portion.

2. A power tool, according to claim 1, wherein said recessed portion comprises a narrow channel.

3. A power tool, according to claim 2 wherein:

said channel opens onto said second end of said body;

a pivot pin is transversely set in said channel adjacent to said second end of said body; and said lever is pivotably journalled on said pin.

* * * * *